US005716024A

United States Patent [19]

Kaufmann et al.

[11] Patent Number: 5,716,024

[45] Date of Patent: Feb. 10, 1998

[54] YARN SUPPLYING DEVICE

[75] Inventors: Richard Kaufmann; Gunter Leopold, both of Freudenstadt; Christoph Wörner, Baiersbronn, all of Germany

[73] Assignee: Memminger-Iro GmbH, Dornstetten, Germany

[21] Appl. No.: 637,035

[22] Filed: Apr. 24, 1996

[30] Foreign Application Priority Data

May 6, 1995 [DE] Germany ..... 195 16 719.8

[51] Int. Cl.[6] ..... B65H 49/02; B65H 75/00; D04B 15/48

[52] U.S. Cl. ..... 242/564.5; 242/594.2; 242/131; 66/132 T

[58] Field of Search ..... 242/564.5, 594.1, 242/594.2, 595.1, 131, 18; 66/132 R, 132 T, 125, 128, 129

[56] References Cited

U.S. PATENT DOCUMENTS

| | | | |
|---|---|---|---|
| 4,651,938 | 3/1987 | Memminger et al. | 242/564.5 |
| 4,681,272 | 7/1987 | Brunner et al. | 66/132 R X |
| 5,509,617 | 4/1996 | Chen | 242/564.5 |

FOREIGN PATENT DOCUMENTS

| | | | |
|---|---|---|---|
| 0 351 722 | 1/1990 | European Pat. Off. . | |
| 1 201 645 | 1/1960 | France . | |
| 1201645 | 1/1960 | France | 242/564.5 |
| 32 33 869 | 3/1984 | Germany . | |
| 43 11 425 | 10/1994 | Germany . | |
| 187 394 | 7/1992 | Taiwan . | |
| 205 254 | 1/1993 | Taiwan . | |

OTHER PUBLICATIONS

P.I. Orlov, "The foundations of the design", Jan. 1988, Reference – procedure book in two books, Book 1, 3rd edition with corrections, editor Dr. P.N. Uchaev, Moscow.

*Primary Examiner*—Michael Mansen

*Attorney, Agent, or Firm*—Frishauf, Holtz, Goodman, Langer & Chick, P.C.

[57] ABSTRACT

A feeder device for feeding elastomer yarns in knitting machines has a housing split into two parts, on which bearing and drive rollers are rotatably supported, spaced apart from and parallel to one another. The housing encloses an internal chamber that accommodates gears for driving at least one of the bearing and drive rollers. The gears transmit force from a drive wheel, which is secured to a shaft protruding from the housing, to at least one bearing and drive roller. The bearing and drive rollers are supported via ball bearings, which are retained by corresponding bearing seats provided in the housing. The bearing seats are recessed in the respective integrally formed housing parts, which are preferably made by injection molding. The dividing line at which the housing parts border on one another extends through all the bearing seats, so that the ball bearings are retained between the housing parts.

Securing the housing parts to one another fixes the ball bearings as well, simultaneously.

30 Claims, 9 Drawing Sheets

YARN SUPPLYING DEVICE

REFERENCE TO RELATED PATENT DISCLOSURES

German 32 33 869

Taiwanese Utility Model Publication No. 205 254

Taiwanese Utility Model TW 187 394.

FIELD OF THE INVENTION

The present invention relates to a device for supplying yarns, and especially elastomer yarns.

BACKGROUND

Particularly in knitting machines, when elastomer yarns are being processed they cannot be drawn from the bobbins of a creel. Because of the longitudinal stretchability of elastomer yarns, it is instead necessary to drive the bobbins so that the yarns are fed to the knitting stations at a low yarn tension that remains constant over time. For driving the bobbins, devices are present in relatively large numbers in the corresponding knitting machines.

These devices are provided at special units on the knitting machines and are secured by suitable clamps to a section, intended for that purpose, of the machine frame. For existing knitting machines, these devices are supplied as needed as a vendor part and are mounted on the machines. It is desirable that this be doable as simply and quickly as possible.

German Patent Disclosure DE 32 33 869 C2 discloses a device for supplying elastomer yarns for knitting machines that has a housing, enclosing an internal chamber, that must be secured to a machine frame. Two drive rollers, each located horizontally and spaced apart parallel from one another, extend through the housing. Each drive roller protrudes from the housing on both ends. Roller bearings are provided in the housing for rotatably supporting the drive rollers. The drive rollers are driven by a toothed belt pulley with a vertically oriented axis. The pulley acts upon the two drive rollers via a cone wheel drive, provided in the interior of the housing, and a toothed belt. The aforementioned toothed belt pulley located outside the housing serves to drive the entire device and communicates with a toothed belt that drives the toothed belt pulleys of a plurality of devices located on the knitting machine.

The housing has flat faces on the sides, with openings through which the drive rollers extend. When the device is assembled, the drive rollers must be thrust through these openings.

From the utility model whose publication number is TW 187 394, a device for feeding elastic yarns is known in which two drive rollers, spaced apart parallel from one another, are each supported via pairs of ball bearings in a bulky recessed retaining body. The thickness of the bulky body is approximately equal to the thickness of two ball bearings immediately adjacent one another. Each drive roller is integral with a toothed belt pulley, which is located laterally beside the bulky retainer. A toothed belt runs over the toothed belt pulleys of the two drive rollers and thus serves to drive them.

The tension of the driving toothed belt running unilaterally, and the closely spaced support of the drive rollers by the ball bearings, limit the alignment of the drive rollers.

From Taiwanese Utility Model Publication No. 205 254, a yarn feeder device for feeding elastomer yarns is known that has a housing split into two parts. In the yarn feeder device, two drive rollers each protruding from the housing on both ends are provided, supported rotatably in the housing parallel to and spaced apart from one another. For that purpose, each drive roller is provided with a bearing device, a bearing plate, and a toothed belt pulley located in its immediate vicinity. The housing is split along a plane on which the drive rollers stand upright. One of the two housing parts has two cylindrical receiving pockets, open on one side, which are capable of receiving the bearing devices seated on the drive rollers. The receiving pockets are each provided with three threaded bores on their periphery for securing the bearing plates. A toothed belt for synchronously driving the two drive rollers runs laterally next to the bearing means over the pulleys. The toothed belt is covered by the other housing part, which does not contain any further bearing means.

This device has the same limitations discussed above. Moreover, the receiving pockets are integrally formed to receive the bearing devices and hence has to be precision-manufactured.

Knitting machines need great numbers of yarn feeder devices.

THE INVENTION

It is an object of the invention to create a device for feeding yarns, and especially elastic yarns, which can be made available in the quantity required at the most economical possible price, and which, moreover, can be assembled and taken apart as simply as possible; and whose bearing and drive rollers are retained in good alignment with one another, while permitting simple manufacture and simple assembly.

Briefly, the yarn feeder device has two bearing rollers, at least one of which is driven. The bearing rollers are located at a spacing from one another preferably such that the minimum spacing between their circumferential surfaces is smaller than the outside diameter of the coil former of the feed bobbin. In operation, the bobbin from which the elastomer yarn is to be drawn is seated on the bearing rollers that rotate in the same direction.

By dividing the housing into two housing parts along a dividing line that extends through the recesses, the housing in the installed position is subdivided into at least one top part and one bottom part. This means that the dividing line extends through or at the edge of openings at which the bearing rollers, at least one of which is driven, protrude from the housing. The bearing rollers can be placed in the recesses directly from the dividing line or may be placed in the recesses having been provided with bearing means; each of the recesses has an opening accessible from the dividing line. The lower housing part, in the position for use, is formed such that it is possible to place the bearing rollers along with the bearing means and the gear means into the lower housing part with the housing open. As a result, it is possible to assemble the device, or in other words put it together, by inserting the parts involved into the lower housing part from the dividing line. For complete assembly and positional fixation of the bearing and drive rollers, bearing means and gear means in the housing, all that needs to be done is to put the other, that is, the upper, housing part on top. In the assembly process, the lower housing part serves as an aid in assembly. No auxiliary devices are required for forcing any parts into corresponding recesses or the like.

A two-shell design of the housing, parted along a dividing line that passes through the aforementioned openings, also makes it possible to create especially simple bearing seats, which are not vulnerable to tolerances, for the bearing means. Corresponding bearing seats are recessed in the two housing parts. Each bearing seat is bounded partly by one housing part and partly by the other housing part. As a result, it is possible for the corresponding bearing means to be clamped between the upper and lower housing parts, without having to manufacture the requisite bearing seats with excessive accuracy. This allows production that does not require overly close tolerances, which is more economical than production with very close tolerances. Cost advantages thus become attainable.

The recess or bearing seat may be formed by a pocket-like recess that has an opening passing through the dividing line. In other words, the mouth of the recess is in a face that forms the dividing line, from which face the recess extends into the housing wall. As a result, the housing parts are largely free of undercuts and can be manufactured inexpensively as simple injection-molded parts.

A simple housing form is obtained if at least in some sections, the dividing line is located in a plane that is oriented both parallel to the pivot axis of the first drive roller and parallel to the pivot axis of the second drive roller. This section is located at the bearing rollers, which makes a simple design of the housing parts possible, especially in this region.

It is also possible for the entire dividing line to be flat, which makes the housing shapes even simpler.

The bearing means received by the housing parts can be protected against being soiled by means of seals acting toward the outside. Moreover, such sealing devices prevent abrasion, dust or lubricant from escaping to the outside from the housing and causing contamination and also prevent dust and contamination from entering the housing from outside.

With the aforementioned design, the housing can be made in a simple way from plastic, especially as an injection-molded part. The accuracy of injection-molded housing parts is sufficient for the intended use, so that because of the location of the dividing line in the region of the bearing means, these parts can be used without remachining.

The retaining devices for retaining the bearing means are preferably recesses provided in the housing parts; the bearing means are firmly clamped in these recesses when the housing is closed. To attain not only a radial fixation of the bearing means but moreover a lateral fixation even if the clamping forces are only slight, the recesses are preferably formed as receiving pockets. They have side walls that fix the bearing means in both axial directions. However, the receiving pockets are accessible from the dividing line, so that when the device is assembled the bearing means can merely be placed in the receiving pockets.

The recesses of the housing parts are preferably formed differently. While the recesses of one housing half receive the bearing means without play and thus determine their position, the recesses of the other housing half can be formed such that the bearing means have a certain amount of play in the direction of the dividing line. The depth of the recess or receiving pocket involved should be dimensioned in such a way, however, that the bearing means is supported in the recess. As a result, the bearing means is seated firmly in the retaining device for the bearing means, which retaining device is formed by opposed recesses. Even beyond this, however, it is possible to connect the housing parts with a certain tolerance. In any case, they need not be positioned precisely relative to one another, so it is unnecessary to use dowels or comparable adjusting means.

The retention of the bearing means is especially nonvulnerable to variations in production and hence secure in terms of the securing of the bearing means, if the retaining devices are provided with spring means. The spring means hold the bearing means on the housing without play. The spring means may be integral portions of the housing part itself.

An embodiment in which the assembly of the device, i.e. putting it together, can be done especially simply has a housing formed such that the bearing rollers and the gear means are completely fixed relative to one another by means of a single housing part. This makes it possible for all the parts to be placed in one housing part in the assembly and thus assembled, and the assembly of the device is then completed by placing the second housing part on top.

The device may be formed such that the bearing rollers protrude from the housing on only one side. However, more bobbins can be simultaneously held and unwound if the bearing rollers protrude from the housing on both sides.

The bearing roller may be either formed in one piece or put together from more than one part. In the multiple-part embodiment, the bearing roller has a middle piece, onto which roller parts are slipped from both ends and secured by clamping screws. In the one-piece version, it is simple to achieve good concentricity of the bearing rollers. This is important for the sake of uniform yarn feeding.

In one embodiment, the gear means engages between two bearings that support the bearing rollers. A uniform load on the bearings is thus attained, which enables precise work on the part of the device.

The gear means is preferably a combined gear wheel and pulley. Between a drive shaft that protrudes from the housing by one end and that has a pulley on that end and a primary shaft supported rotatably in the housing, a bevel gear is provided. This gear has a bevel gear permanently connected to the drive shaft and meshing with one of two bevel gears that are fixed displaceably on the primary shaft by means of clamping screws. The direction of rotation of the primary shaft is made possible by the choice of the gear wheel that meshes with the bevel gear of the drive shaft. A belt serves as the force transmitting means between the primary shaft and the first bearing roller, that is, the bearing roller located closest to the primary shaft. As the belt, possible examples include a round belt, a toothed belt, a flat belt, or the like.

If belts and especially toothed belts are used, then tensioning means for attaining the belt tension are unnecessary.

A toothed belt that operates without slip is advantageous, so that the first bearing roller will have a defined rotary speed. A second toothed belt can extend, as a force transmitting means, between the first bearing roller and the second bearing roller. Compared with an embodiment that has only one toothed belt which runs over the primary shaft and the first and second bearing rollers, this has the advantage of achieving larger wrap angles, so that even with low belt tension, there will be no risk of derailing and hence of unsynchronized travel of the bearing rollers. In addition, metal or plastic chains can be used for drive purposes.

The housing parts can be joined together by simple positive securing means, for instance. These are screw connections or detent connections. Detent connections have the advantage that assembly, given a suitable design, is especially simple and that the detent means can be formed integrally with the housing parts. The detent means may be detent tongues or other kinds of detent protrusions provided on a housing part and engaging corresponding recesses in the other housing part.

The housing parts may moreover be joined together by material engagement, that is, by adhesive bonding or welding, which produces sturdy housing embodiments.

Sensor means, such as switches or the like, for monitoring the bobbins or the yarn travel may be provided on the yarn feeder device. By way of example, these sensor means are carried by a rail, which is provided on the housing and has holding means for the bobbins to be unwound. The sensor means are connected via electrical leads to an electrical connecting device, which is located at a securing device provided for securing the housing to the machine frame. The electrical leads are formed by metal strips placed in the housing, and fixed there by way of example by injection-molded or otherwise formed-on holding nubs.

The metal strips extend across the dividing line, and corresponding resilient contact means are provided at the dividing line, which establish an electrical contact when the housing parts are put together.

In a feature of the invention, an adjustable device for axially fixing the bobbins on the bearing and drive rollers is provided. Preferably, it is the aforementioned rails secured to a housing part, on which a selectively fixable slide having a stop means is seated. The slide is fixed by means of a clamping screw, which is also adjustable during operation of the yarn feeder device.

DRAWINGS

One exemplary embodiment of the invention is shown in the drawing.

DETAILED DESCRIPTION

Figure 1:
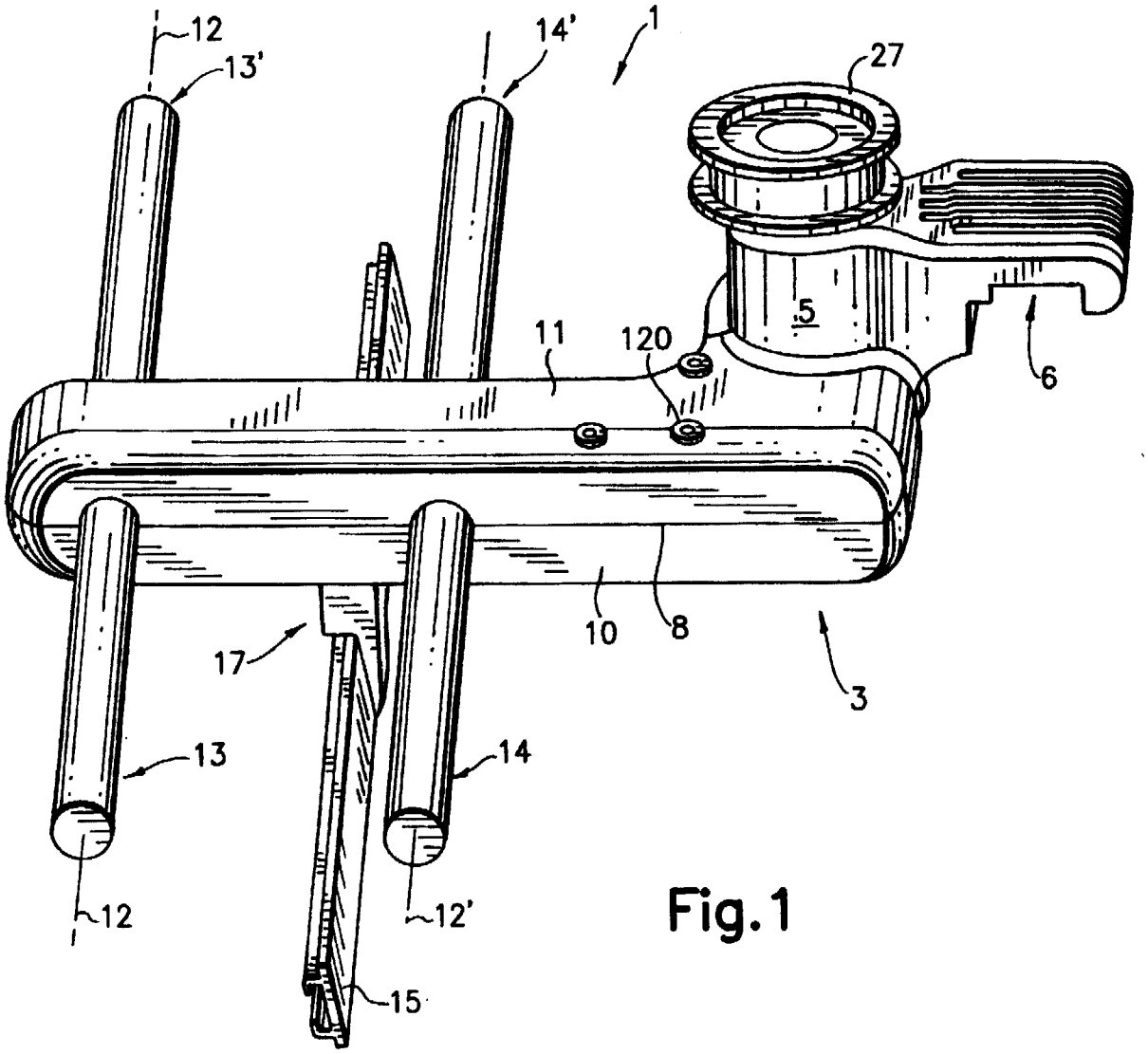
FIG. 1 is a perspective view of a yarn feeder device for elastomer yarns, with a housing split into two parts, for use in knitting machines.

In FIG. 1, a feeder device 1 for elastomer yarns, but without a feed bobbin, is shown. The feeder device is provided for a knitting machine on which a plurality of identical feeder devices 1 are secured. The feeder devices 1 then each receive one or more bobbins and unwind them at a predetermined speed, so that the knitting stations are supplied with the elastomer yarn at a constant yarn tension.

The feeder device 1 has a housing that is L-shaped in plan view and has rounded edges; its cross section is approximately square, with rounded corners. An attachment piece 5 with a clamp 6 for securing to a machine frame, not otherwise shown, is formed on the shorter leg of the L-shaped housing 3.

The housing 3 is split in two at a dividing line 8 and has a lower housing part 10 and an upper housing part 11, which are each formed as one-piece plastic injection-molded parts. The dividing line 8 is located in a plane that intersects the housing 3 approximately in the middle. If needed, at least one housing part 10 may be provided with a sealing means, such as an integrally formed-on lip The lower and upper housing parts can be joined together by screw connections or detent connections 120.

Two bearing rollers 13, 14; 13', 14', kept spaced apart and parallel from one another, protrude laterally from the housing 3 and serve to receive and drive the bobbins (FIG. 3) that are to be unwound. Such a bobbin is set with its circumferential face on the bearing rollers 13, 14; 13', 14', which in the position for use are horizontal and each rotate about one pivot axis 12, 12', in such a way that upon a rotation of the bearing rollers 13, 14; 13', 14', it rotates about its own bobbin axis. The spacing of the bearing rollers 13, 14 from one another is smaller than the outside diameter of a bobbin coil former that carries the bobbin. The same is true for the bearing rollers 13', 14'.

Figure 3:
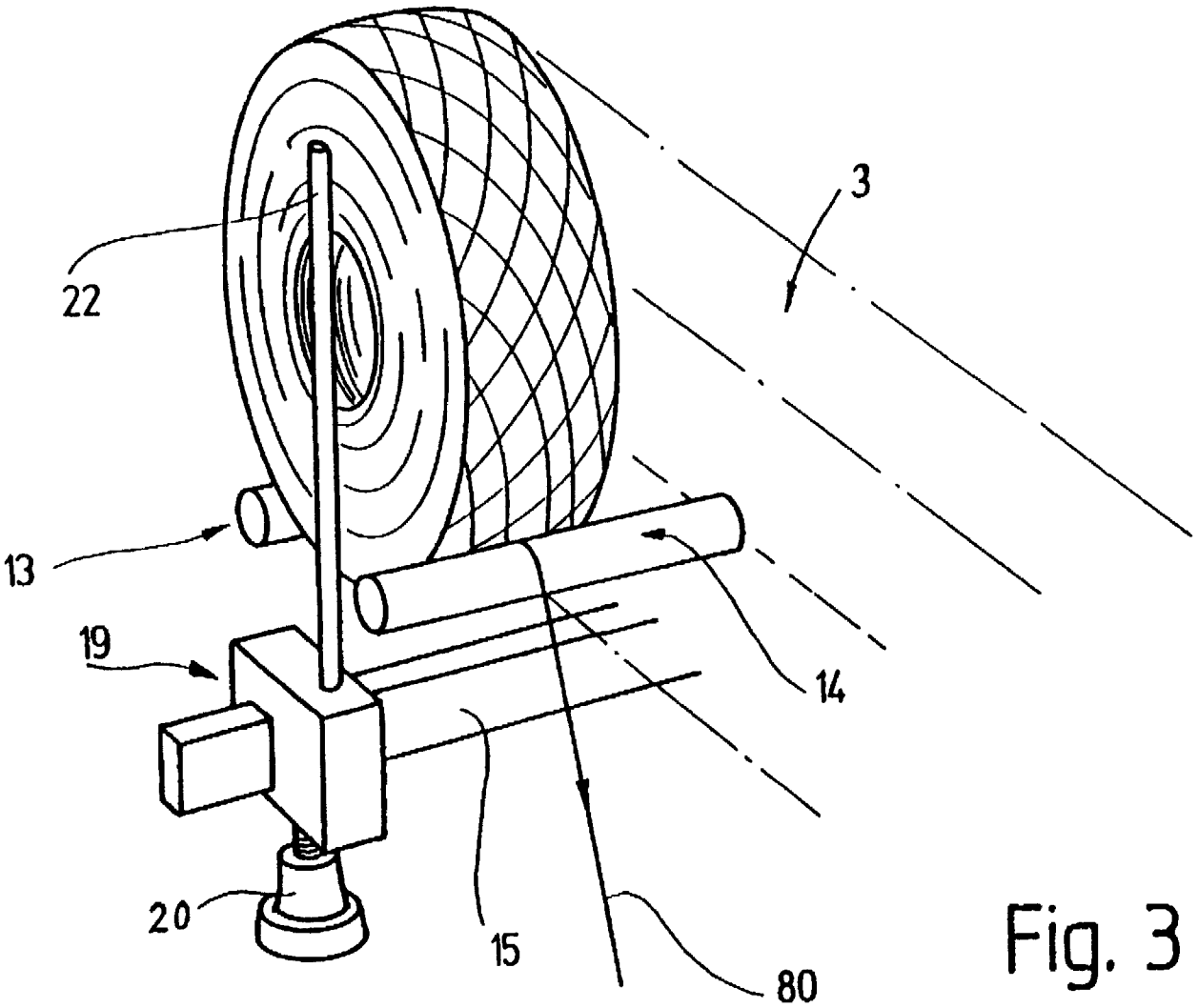
FIG. 3 is a schematic perspective view of the yarn feeder device of FIG. 1 with a yarn bobbin.

Parallel to the bearing rollers 13, 14; 13', 14', but spaced apart from them, there is a rail 15, below the housing 3 in the position for use, which is supported by the housing part 10 by means of a retainer 17 and, as shown particularly in Fig. 3, serves to carry a bobbin limiter 19. This bobbin limiter 19 has a slide, which is displaceable on the rail 15 and can be locked by means of a clamping screw, formed by way of example as a knurled screw 20, and from the slide a limiting bar 22 protrudes far enough upward, approximately at right angles to the rail 15, that a bobbin resting on the bearing rollers 13, 14 is held in its axial direction. A corresponding slide is seated on the section located below the bearing rollers 13', 14'. The bobbin limiter 19 enables simple adaptation to various bobbin widths and to various numbers of bobbins.

Figure 2:
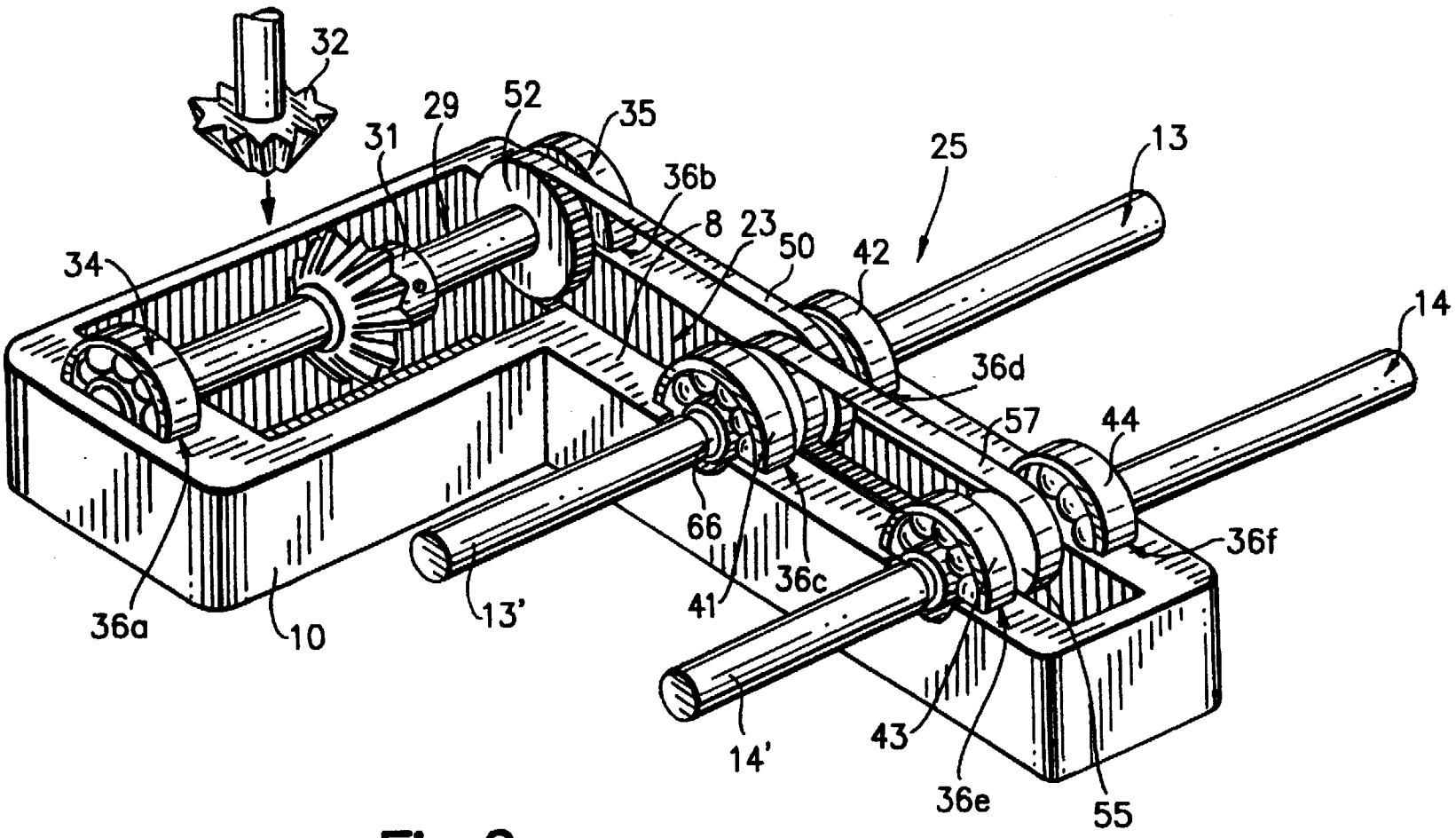
FIG. 2 is a slightly schematic, perspective view of the yarn feeder device of FIG. 1 with the housing open.

The bearing rollers 13, 14; 13', 14' extend through an internal chamber 23, defined by the housing and visible in FIG. 2, for example, in which chamber gear means for driving the bearing rollers 13, 14 are located. The gear means 25 connect a drive wheel 27, visible from FIG. 1, for instance, to the bearing rollers 13, 14; 13', 14'. The drive wheel 27 is rotatably supported by means of a shaft that in use is vertical, or in other words oriented at right angles to the bearing rollers 13, 14; 13', 14', and that is shown separately in FIG. 2, and this drive wheel is driven to rotate via a drive belt provided on the knitting machine.

Figure 4C:
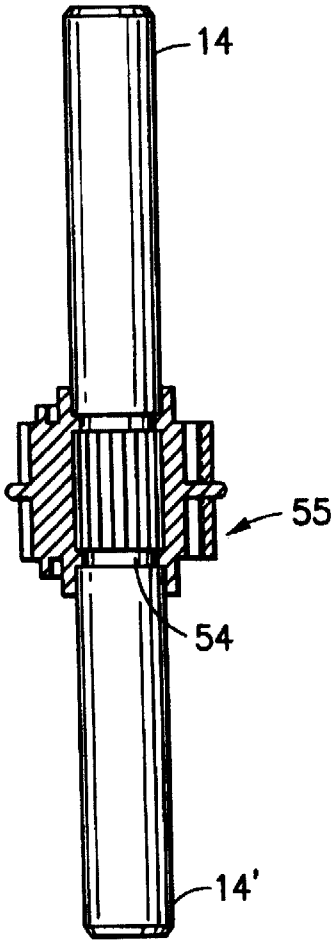
FIG. 4C is a view showing two bearing and drive rollers used to drive the bobbin shown in FIG. 3.
Figure 4B:
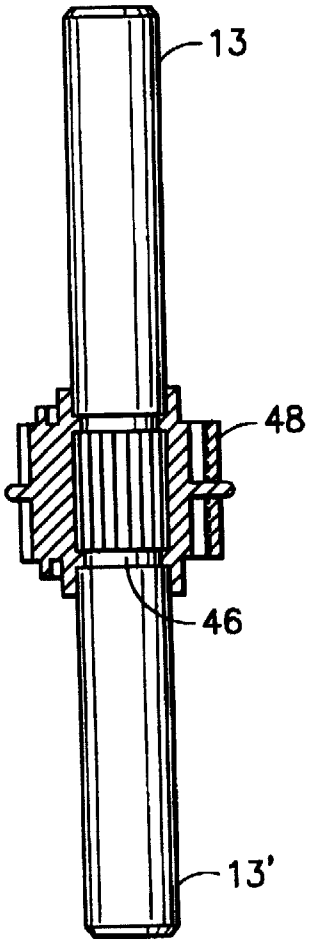
FIG. 4B is a view showing two bearing and drive rollers used to drive the bobbin shown in FIG. 3.
Figure 4A:
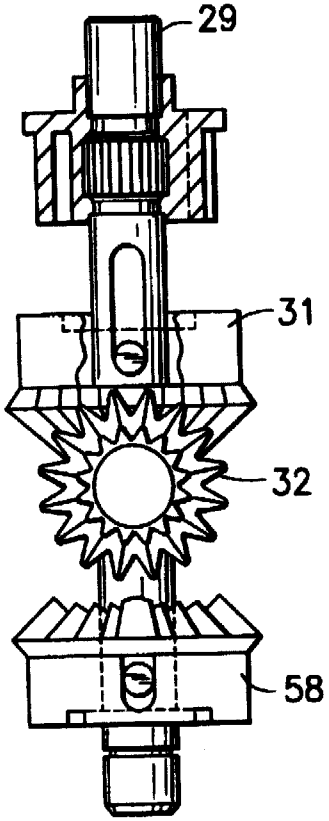
FIG. 4A is a view showing shafts and gear elements received by the housing of the yarn feeder device of FIG. 1.

The gears means 25 serving to transmit force from the drive wheel 27 to the bearing rollers 13, 14, and the supporting of the bearing rollers 13, 14; 13', 14' on the housing 3 can be seen from FIG. 2. A primary shaft 29, which carries a bevel gear 31, is rotatably supported in the shorter leg of the internal chamber 23, which like the housing 3 is L-shaped. As can be seen from FIG. 4, the bevel gear 31 meshes with a bevel gear 32, which in turn is seated, in a manner fixed against relative rotation, on the shaft driven by the drive wheel 27. On both ends, the shaft 29 is rotatably supported by means of ball bearings 34, 35, which are received in a manner to be described hereinafter in recesses 36*a*, 36*b* of the housing or of the housing parts 10, 11, respectively, these recesses forming retaining devices for the ball bearings 34, 35.

Further recesses 36c, 36d and 36e, 36f are provided in the longer leg of the housing 3 for receiving ball bearings 41, 42, 43, 44. The recesses 36c, 36d are located such that they support a shaft 46 (FIG. 4) that on its end carries the bearing rollers 13, 13'. The bearing rollers 13, 13' are aligned parallel with the shaft 29.

The shaft 46 carries a toothed belt pulley 48, which is driven via a toothed belt 50 by a toothed belt pulley 52 seated on the shaft 29.

Figure 5:
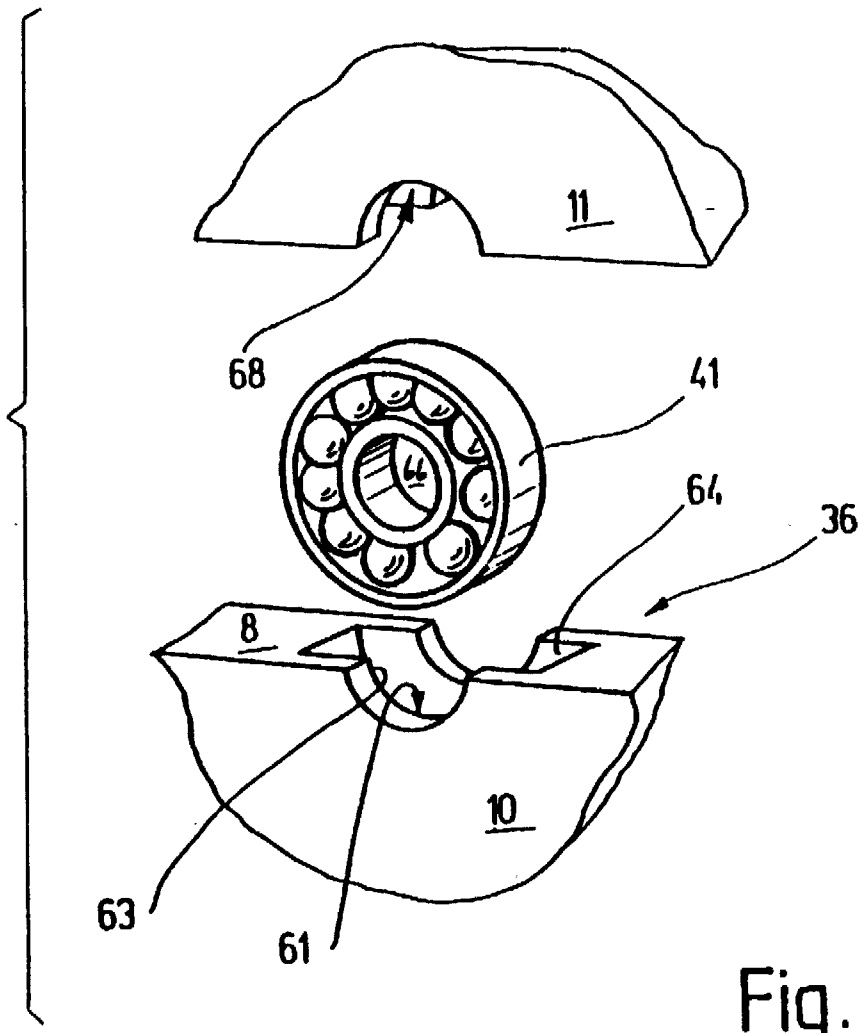
FIG. 5 is a detail, shown in perspective, of the housing of the yarn feeder device of FIG. 1 with a roller bearing received by the housing.
Figure 6:
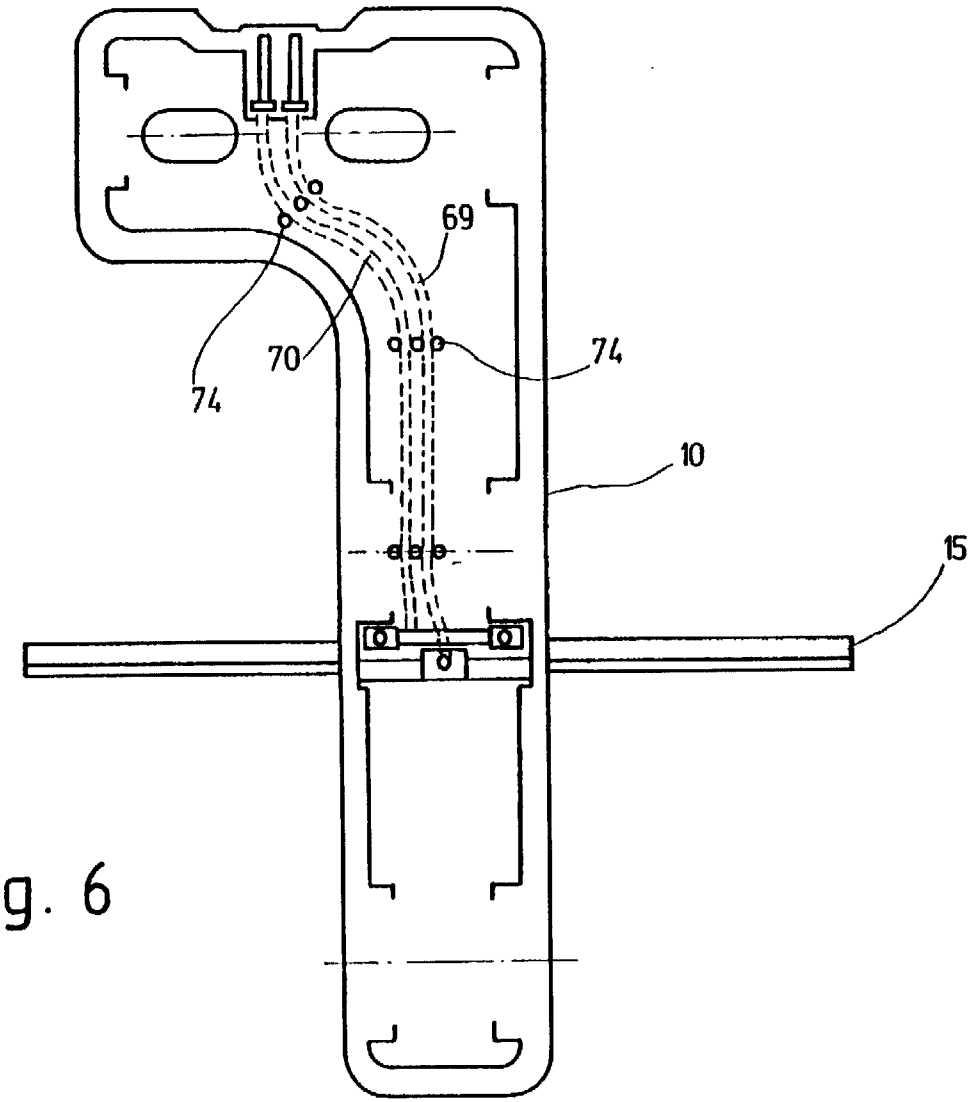
FIG. 6 is a plan view of the housing part of the yarn feeder device of FIG. 1 with its electrical wiring.
Figures 7A, 7B, 7C, 7D:
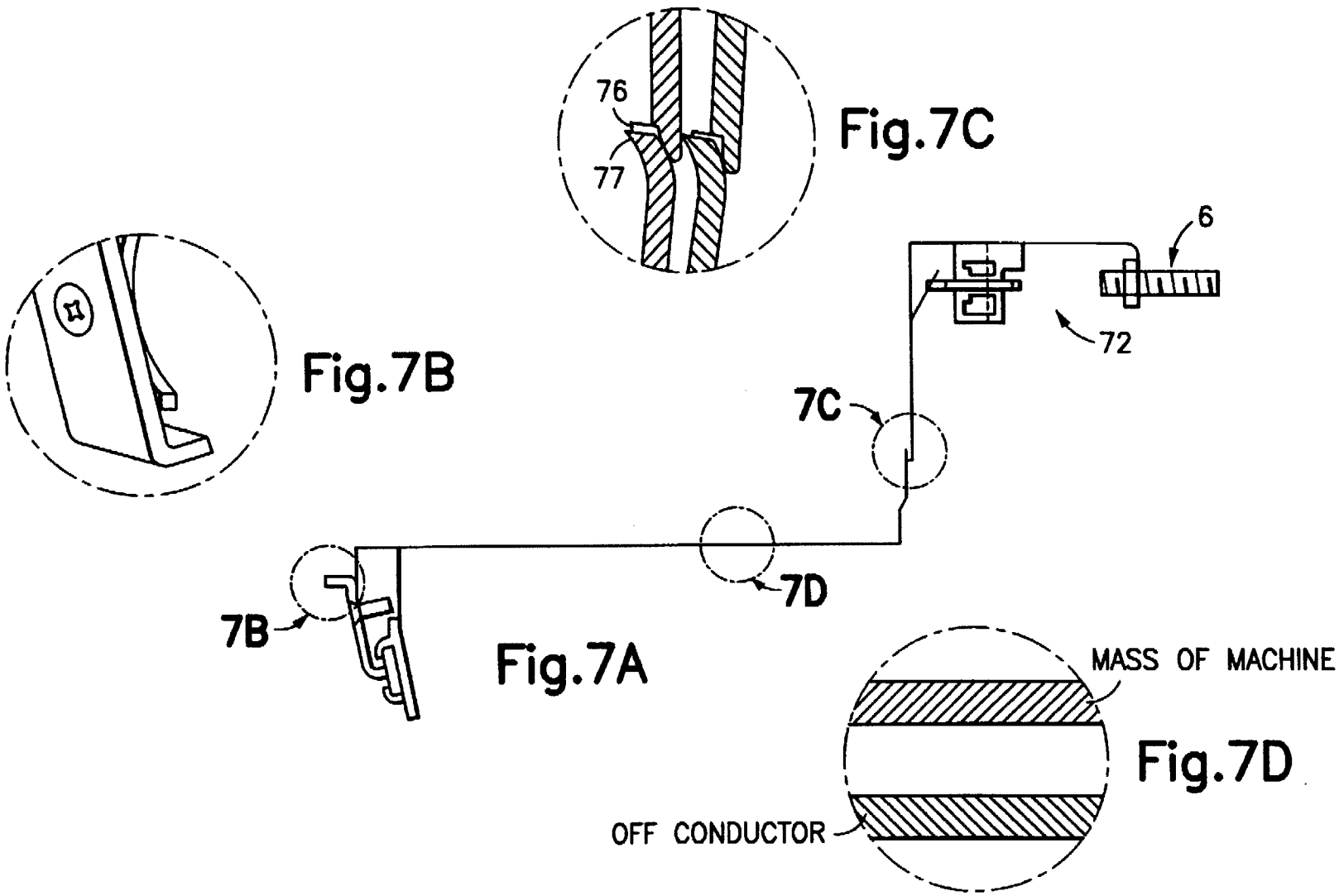
FIG. 7A is a schematic side view, without a housing part, of the layout of the electrical leads provided in the housing of the yarn feeder device of FIGS. 1 and 3.
FIG. 7B is an enlarged view of the connection of electrical lead 70 to rail 15.
FIG. 7C is an enlarged view of spring tongues 76, 77.
FIG. 7D is an enlarged view of electrical leads 69 and 70; embodiments of housings of the yarn feeder device, with roller bearings received by the housings.

Correspondingly, a shaft 54 that on its end carries the bearing and drive rollers 14, 14' is supported by the ball bearings 43, 44. The shaft 54 is provided with a toothed belt pulley 55, which is driven via a toothed belt 57 by the toothed belt pulley 48 seated on the shaft 46. Although for simplicity this is not shown in FIG. 2, but is shown only in FIG. 4A, a further bevel gear 58 may be provided on the shaft 29, enabling a reversal of the direction of rotation of the shaft 29. To that end, the bevel gear 31, 58 are located displaceably on the shaft 29 and can be made to mesh selectively with the bevel gear 32. The recesses 36a–36f provided in the housing parts 10, 11 for receiving the ball bearings 34, 35, 41, 42, 43, 44 are all formed identically, except for the single difference that the housing 3 is open toward the outside at the recesses 36c–36f but otherwise is closed. As a representative for all the recesses, FIG. 5 shows a recess 36, which is formed in the applicable wall of the housing parts 10, 11. Beginning at the dividing line 8, a semicylindrical receiving pocket 61 is located in the lower housing part 10; its radius is equivalent to the outer radius of a ball bearing received by the receiving pocket 61, for which the ball bearing 41 is shown as an example. The width of the recess, measured crosswise to the wall, is equivalent to the width of the ball bearing 41 measured in its axial direction. Laterally, or in other words in the axial direction in terms of the ball bearing 41, the receiving pocket 61 is defined by flat cheecks 63, 64, spaced apart parallel from one another, which cover the ball bearing 41 except for its inner raceway opening 66.

A corresponding receiving pocket 68 is formed in the upper housing part 11 and located such that when the housing 3 is closed, it is flush against the receiving pocket 61.

As seen from FIGS. 6 and 7A–7D, the housing includes electrical leads 69, 70, for making a connection between sensors or switches, provided on the feeder device 1, and electrical connecting means 72 located in the region of the clamp 6. For that purpose, the lead 70 is grounded and is connected to the rail 15. The lead 69 leads from the clamp 6 to a connection for a shutoff switch, not otherwise shown.

The leads 69, 70 extend across the dividing line 8; the metal strips that form the leads 69, 70 are interrupted at the dividing line 8, and each terminates in spring tongues 76, 77. The spring tongues 76, 77 are resiliently prestressed elastically toward one another and thus assure that the electrical contact with be made. No soldering work is needed for making this contact. The connection of the leads 69, 70 to corresponding leads of the knitting machine is automatically made in the region of the clamp 6 by plug-type or-clamp connections, without requiring special provisions, when the feeder device 1 is secured to the knitting machine.

The device described thus far functions as follows:

The feeder device 1 is installed on the machine frame of a knitting machine by means of the clamp 6. A toothed belt that drives a plurality of identical feeder devices is placed across the drive wheel 27. Bobbins with yarn to be unwound are mounted on the bearing rollers 13, 14; 13', 14' in the manner suggested in FIG. 3. When the drive wheel 27 is driven by the aforementioned but not otherwise shown toothed belt, the gear means 25 transmits the rotary motion to the bearing rollers 13, 14; 13', 14', so that a yarn 80 is paid out at a predetermined speed and in a predetermined direction.

The assembly of the feeder device 1 from its individual parts is as follows:

The gear means 25 and ball bearings 34, 35, 41, 42, 43, 44 are placed in the lower housing part 10, as shown in FIG. 2; the housing part 11 is thereupon put on top and secured to the housing part 10. Screws or detent means, not otherwise shown, can be used for this purpose.

Specifically, the shaft 29 is provided with the bevel gear 31 and the toothed belt pulley 52; the toothed belt 50 is placed on the toothed belt pulley 52, and the shaft 29 is provided with its ball bearings 34, 35 and is placed in the recesses 36a, 36b. Next, the shaft 46 is provided with the toothed belt pulley 49 and the bearing rollers 13, 13'. Once the ball bearings 41, 42 have been slipped on and the toothed belts 50, 57 have been put in place, the ball bearings 41, 42 are placed in the recesses 36c, 36d. The bearing rollers 14, 14' are installed in a corresponding manner.

The entire process can be done without additional aids and without special tools. It is simple and can be done by untrained workers. Once the upper housing part 11 is put in place, the feeder device 1 is completely assembled.

The housing parts 10, 11 are injection-molded parts, which have all the requisite securing devices to receive parts that are to be joined to one another, in the form of integrally formed protrusions or recesses provided in them. The recesses 36 in particular are formed such that they can receive the ball bearings without remachining, and such that the ball bearings are retained in stationary fashion when the housing parts 10, 11 are put together. To that end, besides the receiving pockets 61, 68 described, bearing seats 84a–84d can alternatively be provided, which are shown in FIGS. 8–12.

Figure 8:
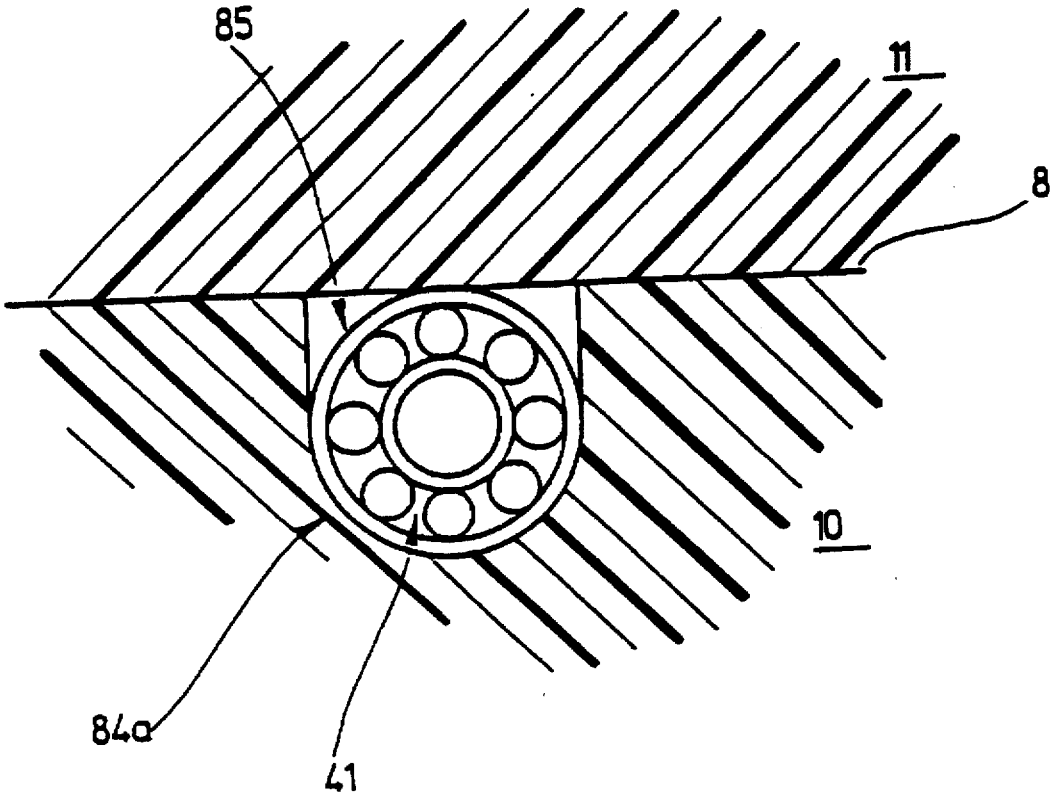

In the embodiment shown in FIG. 8, all the bearing seats 84a provided instead of the recesses 36a–36f in the housing 3 are identical in form. In the housing part 10, a pocket 85 is provided whose depth matches the diameter of the ball bearing 41, which is shown here to represent all the ball bearings. On the bottom, the pocket 85 is formed as half-round, so that the ball bearing 41 rests without play in the pocket 85. Axially, the pocket 85 is defined by cheeks not otherwise shown, which retain the ball bearing 41 axially without significant play. The housing part 11 is formed as flat at the dividing line 8 and has no recesses whatever. It retains the ball bearing 41 in the pocket 85. However, as in all the exemplary embodiments, the bearing seat 84a (and b–e) is formed between the housing parts 10, 11.

The advantage of the above embodiment is its ease of assembly. The ball bearings are laterally fixed after being placed in their respective pockets 85, so that the assembly can proceed simply even if the toothed belts 50, 57 (FIG. 2) are supposed to be taut. The bearing seat 84a is also markedly free of vulnerability to inaccurate assembly of the housing parts 10, 11 relative to one another. The relationship of the housing parts 10, 11 to one another plays no role for the bearing seat 84a.

The dividing line 8 defines the bearing seat 84a on one side and at the same time forms the closure thereof.

Figure 9:
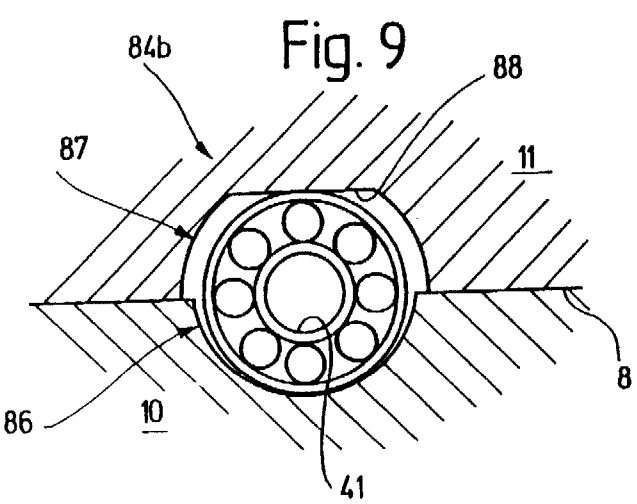

FIG. 9 shows another embodiment of a bearing seat 84b. In this embodiment, recesses or pockets 86, 87 are provided both in the upper housing part 11 and in the lower housing part 10. The pocket 86 of the lower housing part 10 is semicylindrical, and the radius slightly exceeds the radius of the outer raceway of the ball bearing 41, which is shown again here to represent the others. The pocket 87 provided in the upper housing part 11 has a flat bottom 88, which rests on the outer raceway of the ball bearing 41. The distance between the bottom 88 and the low point of the pocket 88 is equal to the diameter of the ball bearing 41.

The recesses or pockets 86, 87, which like all the bearing seats again have cheeks at the side, border one another at the dividing line 8, which passes centrally through the ball bearing 41.

In this bearing seat **84*b*, a displacement of the housing parts 10, 11 relative to one another is possible without impairing the seat of the bearing 41**. Variations in production can thus be compensated for.

Figure 10:
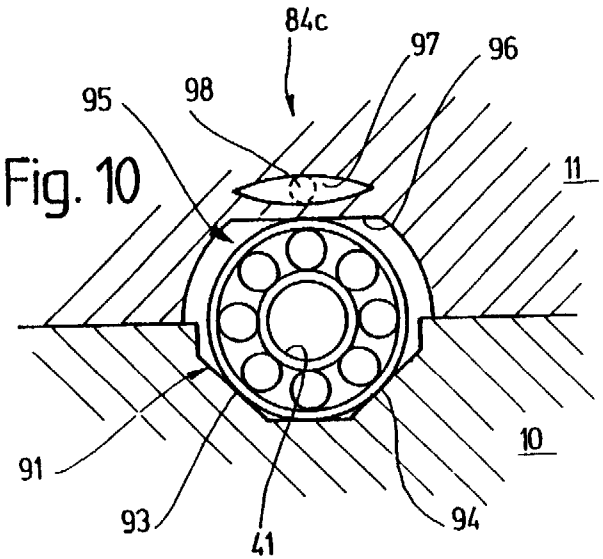

FIG. 10 shows a further bearing seat **84*c*, which enables a resilient reception of the ball bearing 41 and thus assures even greater freedom from tolerances. In the housing part 10, a receiving pocket 91 is formed, which differs from the aforementioned recesses and pockets of the housing part 10 in that it receives the ball bearing 41 in prism-like fashion. To that end, the receiving pocket 91 has two flat bearing faces 93, 94**, which are substantially at a right angle to one another and on which the outer raceway of the ball bearing rests with linear contact at two points.

A receiving pocket 95 provided in the upper housing part 11 has a flat but resiliently formed bottom 96, on which the outer raceway of the ball bearing 41 rests. The bottom 96 is elastically deformed by the ball bearing 41. The ball bearing 41 is received at three points in the bearing seat **84*c*. The resiliently yielding bottom 96 assures a secure seat of the ball bearing 41** even when the tolerances are relatively wide.

The yielding resilience of the bottom 96 can be preserved by means of a suitable double-convex recess 97, which is located a short distance from the bottom 96 in the housing part 11. If needed, a spring element 98 may be located in the recess 97.

Figure 11:
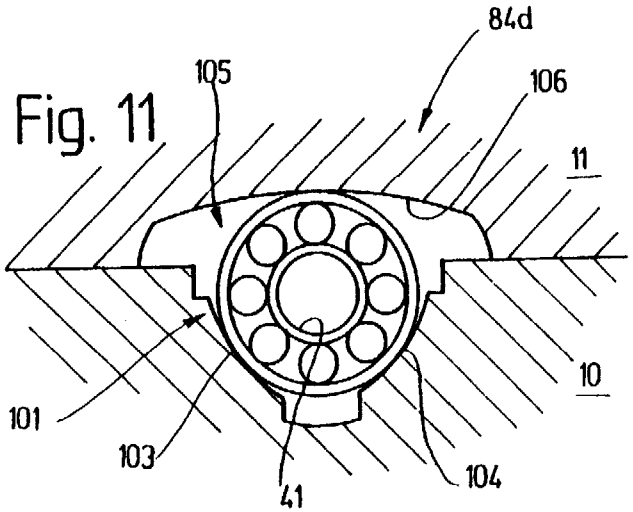

FIG. 11 shows a modified embodiment of a bearing seat **84*d*. In the housing part 10, a receiving pocket 101 is formed that receives the ball bearing 41 in prism-like fashion. To that end, the receiving pocket 101 has two curved bearing faces 103, 104, substantially at a right angle to one another, on which the outer raceway of the ball bearing rests at two points. Because of the curvature of the bearing faces 103, 104, the ball bearing 41 rests with somewhat larger areas of it on the bearing faces 103, 104**.

A receiving pocket 105 provided in the upper housing part 11 has a curved bottom 106, on which the outer raceway of the ball bearing 41 rests. The ball bearing 41 is received in the bearing seat **84*d* at three points. The radius of curvature of the bottom 106 exceeds the diameter of the outer raceway of the ball bearing 41** markedly. Freedom from vulnerability to tolerances is attained as a result.

Figure 12:
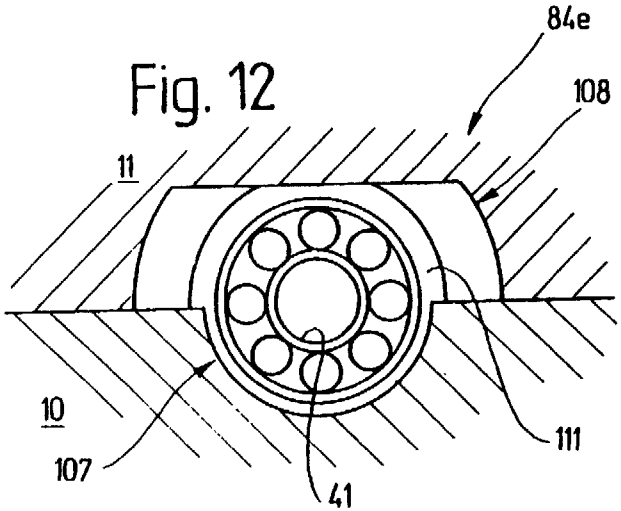

Finally, FIG. 12 shows a bearing seat **84*e* that is quite similar to the bearing seat 84*b* of FIG. 9. Mowever, a recess 107 provided in the housing part 10 has a larger diameter than the recess 86 of the exemplary embodiment of FIG. 9. In the housing part 11, a recess 108 is provided which has a greater depth than the recess 87. The ball bearing 41 is retained in the recesses 107, 108 by means of an O-ring 111. The O-ring 111 forms a spring element that holds the ball bearing 41 in the bearing seat 84*e* in a way that largely compensates for manufacturing tolerances. The O-ring engages a groove, which is provided if needed but is not shown in the drawing, on the bottom of the recess 107**.

An O-ring may also be provided as a spring or compensating element in all the other embodiments of the feeder device 1 that are described above. The diameters and depths of the corresponding bearing seats **84*a*–84*e*** should then be defined accordingly.

In a departure from the exemplary embodiment just described, both the bearing rollers 13, 13' and the bearing rollers 14, 14' may each be formed in one piece. It is also possible for the bearing rollers 13, 13'; 14, 14' to be formed in one piece with the toothed belt pulleys 48, 55. Good concentricity, easy assembly and low production costs are then attained.

Embodiments are also possible in which one housing part in accordance with FIGS. 9–12 can be combined with an arbitrary other housing part in accordance with FIGS. 4–12.

A feeder device for feeding elastomer yarns in knitting machines has a housing split into two parts, on which bearing rollers are supported rotatably, spaced apart parallel from one another. The housing encloses an internal chamber that accommodates gear means for driving at least one of the bearing rollers. The gear means transmit force from a drive wheel, which is secured to a shaft protruding from the housing, to at least one bearing roller. The bearing rollers are supported via ball bearings, which are retained by corresponding bearing seats provided in the housing. The bearing seats are formed in the housing parts, which are each made in one piece and are preferably produced by injection molding. The dividing line at which the housing parts border one another extends through all the bearing seats, so that the ball bearings are retained between the housing parts. The ball bearings are simultaneously fixed by securing the housing parts to one another.

We claim:

1. A device for supplying yarn, comprising:

a housing (3) having a wall enclosing an internal chamber, said housing including first and second housing parts (10, 11) having respective first and second complementary surfaces which are substantially parallel to a dividing line (8);

at least a first bearing roller (13, 13'), held stationary and supported on the housing (3) so as to be rotatable about a first rotation axis (12);

at least a second bearing roller (14, 14'), held spaced apart from and parallel to the first bearing roller (13, 13') and supported on the housing (3) so as to be rotatable about a second rotation axis (12');

a recess (36), formed in the wall of at least one of the first and second housing parts (10, 11), through which the bearing rollers (13, 13'; 14, 14') extend and into which the first and second bearing rollers (13, 13'; 14, 14') extend from the dividing line (8) crosswise to a respective one of the first and second rotation axes (12, 12') such that said recess (36) forms a bearing seat having a bearing seat face on at least one of the first and second housing parts;

a drive mechanism for rotatingly driving at least one of the bearing rollers (13, 13'; 14, 14');

a securing means for joining the housing parts (10, 11) to one another; and a securing device (6) for retaining the housing (3) on a machine frame;

wherein at least one of the first and second complementary surfaces and the dividing line (8) intersects or contacts the bearing seat; and wherein at least a portion of the bearing seat face of at least one of the first and second housing parts is resilient.

2. The device of claim 1, further comprising bearing seats (84) defined by the recess (36), and bearing means (41, 42, 43, 44) positioned within the bearing seats such that at least one of the first and second bearing rollers (13, 13', 14, 14') is rotatably supported with low friction.

3. The device of claim 2 characterized in that the bearing seats (84) are configured so as to retain the bearing means (41) therein without substantial movement along a respective one of the first and second rotation axes.

4. The device of claim 2, characterized in that the bearing seats (84) are formed within at least one of the first and second housing parts (10, 11) such that bearing seats define the spatial location of the bearing means (41, 42, 43, 44), while the recesses (36) are formed on the other of the first and second housing parts (10, 11) in such a way that the spatial relationship with the bearing means (41) is variable within limits.

5. The device of claim 1, characterized in that the recess (36) is defined by a depression within the first and second housing parts (10, 11) having an opening that intersects a respective one of the first and second complementary surfaces.

6. The device of claim 5, characterized in that the opening, with one boundary defined by a plane parallel to a respective one of the first and second complementary surfaces, defines surfaces that are non-perpendicular to respective first and second rotation axes (12, 12').

7. The device of claim 1, characterized in that the drive mechanism includes at least one gear means (25) connected to a drive wheel for transmitting force from the drive wheel (27) to the bearing roller (13, 13'; 14, 14').

8. The device of claim 7, characterized in that each of the bearing rollers (13, 13'; 14, 14')includes two bearings (41, 42; 43, 44), between which the at least one gear means (25) acts upon the bearing rollers (13, 13'; 14, 14').

9. The device of claim 7, characterized in that the gear means (25) is slipless.

10. The device of claim 7, characterized in that the gear means (25) includes at least one means for transmitting force by frictional engagement.

11. The device of claim 7, characterized in that the gear means (25) includes a bevel gear (31, 32, 58), which operatively couples a drive shaft and a primary shaft (29) and enables a reversal of a direction of rotation.

12. The device of claim 11, characterized in that the transmission of force from the primary shafts (29) to the at least a first bearing roller (13, 13') is effected via one of a belt (50) and a chain.

13. The device of claim 11, characterized in that the transmission of force from the first bearing roller (13, 13') to the second bearing roller (14, 14') is effected via one of a belt (57) and a chain.

14. The device of claim 1, characterized in that the dividing line (8) is at least partially located in a plane that is parallel to at least one of the first and second rotation axes (12, 12').

15. The device of claim 1, characterized in that the dividing line (8), in a section that includes the bearing rollers (13, 13'; 14, 14') is located in a plane that is parallel both to the rotation axis (12) of the first bearing roller (13, 13') and to the rotation axis (12') of the second bearing roller (14, 14').

16. The device of claim 1, characterized in that in the dividing line (8) is substantially contained in a plane that is parallel to both the rotation axis (12) of the first bearing roller (13, 13') and to the rotation axis (12') of a second bearing roller (14, 14').

17. The device of claim 1, characterized in that the housing (3) is made of a plastic.

18. The device of claim 1, characterized in that the recesses (36) include a resilient member (96, 97), which acts upon at least one of the bearing rollers (13, 13'; 14, 14') and bearing means (41) in such a way that the respective one of the bearing rollers (13, 13'; 14, 14') and the bearing means (41) are retained without movement within the housing (3).

19. The device of claim 1, characterized in that the first and second housing parts (10, 11) and the recesses (36) are configured such that each of the bearing rollers (13, 13'; 14, 14') are fixed with respect to one another.

20. The device of claim 1, characterized in that the at least first and second bearing rollers (13, 13'; 14, 14') extend through the housing (3) and protrude out of the housing (3) by both ends (13, 13'; 14, 14').

21. The device of claim 1, characterized in that each of the bearing rollers includes a plurality of shaft sections (13, 46, 13').

22. The device of claim 1, characterized in that each of the bearing rollers (13, 13'; 14, 14') is formed in one piece.

23. The device of claim 1, characterized in that the securing means for connecting the first and second housing parts (10, 11) to one another are positive securing means.

24. The device of claim 1, characterized in that the securing means for connecting the first and second housing parts (10, 11) to one another are detent means.

25. The device of claim 1, characterized in that the first and second housing parts (10, 11) are joined to one another by material engagement.

26. The device of claim 1, characterized in that the device includes a rail (15), on which sensors means are secured to monitor the yarn being supplied.

27. The device of claim 26, characterized in that the device includes electrical leads (69, 70) for connecting the sensor means to a connecting device which is provided for the securing device (6).

28. The device of claim 27, characterized in that the electrical leads (69, 70) are metal strips embedded in the first housing part (10), and wherein the device includes contact tongues (76, 77) along the dividing line (8) for contacting metal strips that are provided on the second housing part (11).

29. The device of claim 27, characterized in that the electrical leads (69, 70) and the first and second housing parts (10, 11) are formed such that the electrical contacting of the sensor means can be accomplished without soldering.

30. The device of claim 1, characterized in that the device further comprises retaining means (19), which limits the mobility of the bobbin in an axial direction along the bearing rollers (13, 13'; 14, 14') and that is adjustable along the axial direction of the bearing rollers (13, 13'; 14, 14').

* * * * *